US006005528A

United States Patent [19]

Preiss et al.

[11] Patent Number: 6,005,528

[45] **Date of Patent: *Dec. 21, 1999**

[54] DUAL BAND FEED WITH INTEGRATED MODE TRANSDUCER

[75] Inventors: Joseph A. Preiss, Westford; Edward A. Geyh, Groton; Fernando Beltran, Framingham, all of Mass.

[73] Assignee: Raytheon Company, Lexington, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/804,417

[22] Filed: Feb. 20, 1997

Related U.S. Application Data

[63] Continuation of application No. 08/397,704, Mar. 1, 1995, abandoned.

[51] Int. Cl.[6] ..... H01Q 13/00

[52] U.S. Cl. ..... 343/786; 343/785; 343/781 R; 333/126

[58] Field of Search ..... 343/783, 785, 343/786, 781 R; 333/11, 126; H01Q 13/00

[56] References Cited

U.S. PATENT DOCUMENTS

| | | | |
|---|---|---|---|
| 3,605,101 | 9/1971 | Kolettis et al. | 343/786 X |
| 3,922,621 | 11/1975 | Gruner | 333/11 |
| 4,419,671 | 12/1983 | Noerpel | 343/786 |
| 4,468,672 | 8/1984 | Dragone | 343/783 |
| 4,472,721 | 9/1984 | Mörz et al. | 343/786 |
| 4,482,899 | 11/1984 | Dragone | 343/786 |
| 4,558,290 | 12/1985 | Lee | 333/126 |
| 4,777,457 | 10/1988 | Ghosh et al. | 333/110 |
| 4,903,037 | 2/1990 | Mitchell et al. | 343/786 X |
| 5,041,840 | 8/1991 | Cipolla et al. | 343/781 R X |
| 5,109,232 | 4/1992 | Monte | 343/786 X |

FOREIGN PATENT DOCUMENTS

| | | | |
|---|---|---|---|
| 3144319 | 5/1983 | Germany | 343/786 |
| 2096399 | 10/1982 | United Kingdom | 343/786 |
| 2099224 | 12/1982 | United Kingdom | 343/786 |

OTHER PUBLICATIONS

"Cross–Polarization Analysis of Dual Frequency Band Corrugated Conical Horns," Isao Nori, Ryuichi Iwata, Akira Abe, NEC Corporation, Proceedings of ISAP 1985, pp. 49–52.

"Mode Conversion Using Circumferentially Corrugated Dylindrical Waveguide," Electronics Letters, Jul. 27th, 1972, vol. 8, No. 16, pp. 394–396.

"Coaxial Waveguide Diplexing Circuit Using a Corrugated Waveguide Transition," R. W. Gruner, COMSAT Laboratories, Clarksburg, Maryland 20971, 1987 IEEE, pp. 692–695.

*Primary Examiner*—Don Wong
*Assistant Examiner*—Tho Phan
*Attorney, Agent, or Firm*—Fish & Richardson P.C.

[57] ABSTRACT

A single radiating structure with an integrated mode transducer that produces near-ideal radiation characteristics at two frequency bands. The dual band feed consists of three main sections: feed waveguide, mode transducer and corrugated horn. The feed waveguide consists of two concentric, circular waveguides that are excited in the $TE_{11}$ coaxial and circular waveguide modes for the low and high bands, respectively. The mode transducer, which is critical to the performance of the feed, provides a single mode, low return loss transition, for both bands, between the feed waveguide and the corrugated horn. This is achieved by converting the $TE_{11}$ circular waveguide modes into the fundamental hybrid, $HE_{11}$, mode of the corrugated horn. The corrugated horn, which is a stepped-slot configuration, is designed to achieve a smooth transition from the mode transducer and to produce the desired radiation characteristics at both frequency bands.

19 Claims, 2 Drawing Sheets

DUAL BAND FEED WITH INTEGRATED MODE TRANSDUCER

This application is a continuation of application Ser. No. 08/397,704 filed Mar. 1, 1995, abandoned.

The Government has rights in this invention pursuant to Contract No. F19628-92-C-0109, awarded by the Department of the Air Force.

BACKGROUND OF THE INVENTION

The present invention relates to a dual band reflector antenna and in particular to a dual band feed having a mode transducer coupled to a feed waveguide and integral to a corrugated horn for providing near ideal performance at both frequency bands.

The performance of a communications terminal is related to the gain of the antenna, the noise figure of the receiver, and the output power of the transmitter. By increasing the gain of the antenna, the performance, and therefore cost of the receiver and transmitter can be reduced while maintaining the same system performance. Since the size of the antenna is typically limited by volume or pedestal constraints, the only means of increasing the antenna gain is to improve the antenna efficiency. To optimize the antenna efficiency, a feed for a reflector system must produce rationally symmetric radiation patterns and have coincident E and H plane phase centers. In an optimal dual band reflector antenna, a single feed must obtain these requirements while maintaining radiation characteristics at both frequency bands.

In the prior art U.S. Pat. No. 3,922,621 by R. W. Gruner, issued Nov. 25, 1975, teaches a 6-port directional orthogonal mode transducer comprising an inner circular waveguide for propagating transmit signals and an outer, circular, coaxial waveguide for propagating lower frequency receive signals. The terminal end of the outer waveguide is joined to an enlarged, cylindrical coupling section provided with a plurality of spaced, inwardly projecting corrugations in the form of washer-like annular rings. The corrugations, when properly dimensioned, establish surface reactance conditions, that result in an inner circular field distribution at the transmit frequency and a surrounding annular field distribution at the receive frequency. Although the transducer provides isolation between the transmit and receive channels, it does not realize the mode structures needed for optimal feedhorn performance.

In the prior art other dual band feeds typically employ separate radiating structures, or configurations, for each frequency band. A typical approach is to utilize a corrugated or multi-mode horn and a dielectric polyrod for the low and high bands, respectively. Such a configuration achieves the desired performance at the low band, but not at the high band. In these feeds the dielectric polyrod does not function as a transition into the corrugated or multimode horn, but rather as a radiator for high band. The dielectric polyrod is narrow band and does not produce rotationally symmetric patterns or stable coincident phase centers.

Another approach is to utilize the same horn operating single mode and multi-mode for the low and high bands, respectively. The multi-mode operation produces non-ideal, but acceptable, performance at the high band, but the low band is far from ideal. Current dual band feeds achieve the desired radiation performance at one band by compromising performance at the other band.

SUMMARY OF THE INVENTION

It is therefore an object of the present invention to provide a single dual band radiating structure that achieves near-ideal radiation performance at both frequency bands.

It is a further object of this invention to provide a dual band reflector antenna having a single feed comprising two concentric circular waveguides, a mode transducer and a corrugated horn.

It is a further object of this invention to provide a method of achieving optimal performance of a dual band feed at both frequency bands.

The objects are further accomplished by providing a dual band feed comprising waveguide means for exciting both frequency bands, corrugated horn means adjacent to the waveguide means for providing predetermined radiation characteristics at both frequency bands. The corrugated horn means comprises mode transducer means including varying stepped-slots on a portion of an inner periphery of the corrugated horn for providing a single mode, low return loss transition for both frequency bands. The waveguide means comprises two concentric circular waveguides wherein a first of the circular waveguides for the low band signal is excited in a $TE_{11}$ coaxial waveguide mode and a second of the circular waveguides for the high band signal is excited in a $TE_{11}$ circular waveguide mode. The mode transducer means converts the $TE_{11}$ coaxial waveguide mode of the low band signals to a $TE_{11}$ circular waveguide mode at the juncture with the waveguide means, and the mode transducer means converts the $TE_{11}$ circular waveguide waveguide mode to a $TE_{11}$ mode as the $TE_{11}$ circular waveguide mode propagates away from said junction with said waveguide means. The low band comprises K-band signals and the high band comprises Q-band signals.

The objects are further accomplished by providing a dual band reflector antenna comprising a main reflector, a sub-reflector means positioned in front of the main reflector for illuminating the main reflector, dual band feed assembly means for transmitting high band signals and receiving low band signals, the feed assembly comprising, (a) waveguide means for exciting the low band signals and the high band signals, (b) corrugated horn means adjacent to the waveguide means for propagating predetermined radiation characteristics for the low band signals and the high band signals, and (c) the corrugated horn means comprises mode transducer means including varying stepped-slots on a portion of an inner periphery of the corrugated horn for providing a single mode, low return loss transition for the low band and the high band signals.

The objects are further accomplished by a method of providing optimal performance of a dual band feed at both frequency bands comprising the steps of exciting low band signals and high band signals with waveguide means, providing predetermined radiation characteristics for the low band signals and the high band signals with corrugated horn means adjacent to the waveguide means, and providing a mode transducer means in the corrugated horn having varying stepped-slots on a portion of an inner periphery of the corrugated horn to provide a single mode, low return loss transition for the low band and the high band signals.

BRIEF DESCRIPTION OF THE DRAWINGS

Other and further features and advantages of the invention will become apparent in connection with the accompanying drawings wherein.

DESCRIPTION OF THE PREFERRED EMBODIMENT

Figure 1:
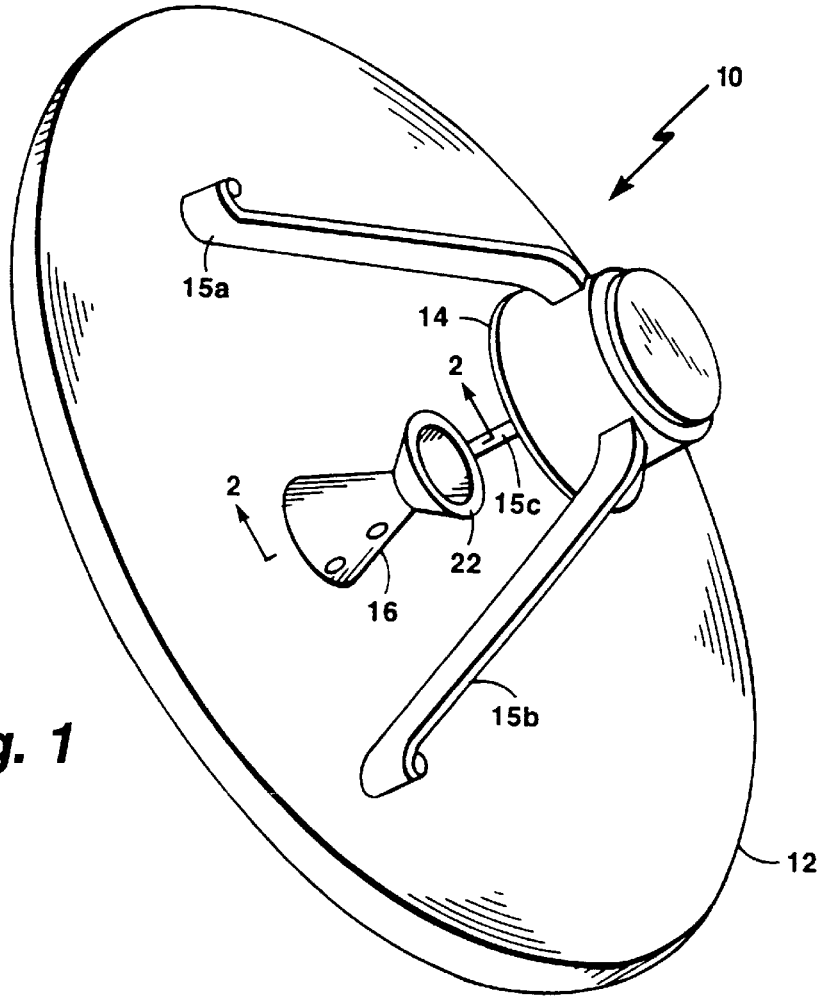
FIG. 1 is a perspective view of a dual band EHF reflector antenna comprising the present invention.

Referring to FIG. 1, a perspective view of a dual band extremely high frequency (EHF) center-fed reflector antenna 10 is shown. Subreflector 14 is positioned in front of a main reflector 12 and is supported by three solid aluminum spars 15*a*, 15*b* and 15*c*, the ends of which are connected to the reflector 12. The cross-section of the spars 15*a*, 15*b* and 15*c* are selected for rigidity and minimum blockage. Disposed at the center of the reflector 12 is a dual band circularly polarized feed assembly 16 comprising a horn 22 to illuminate the subreflector 14. The main reflector 12 is 26 inches in diameter. The subreflector 14 is 5.8 inches in diameter and comprises a solid subreflector and dichroic subreflector not shown separately but known to one of ordinary skill in the art. The main reflector 12 and the solid subreflector are shaped to achieve a uniform phase distribution and the desired aperture illumination at Q-band (high band). The shape of the dichroic subreflector is a compromise between achieving the desired phase or amplitude aperture excitation at K-band (low band) given the shape of the main reflector 12. Since the feed assembly 16 patterns are not significantly different for the two bands, the dichroic shape is close to achieving both the desired phase and amplitude distribution. The desired amplitude excitation for both bands is a near uniform excitation with minimal power in the regions of the subreflector blockage. Although the preferred embodiment comprises a dual band feed at K-band and Q-band, the invention is applicable to other frequency bands.

Figure 2:
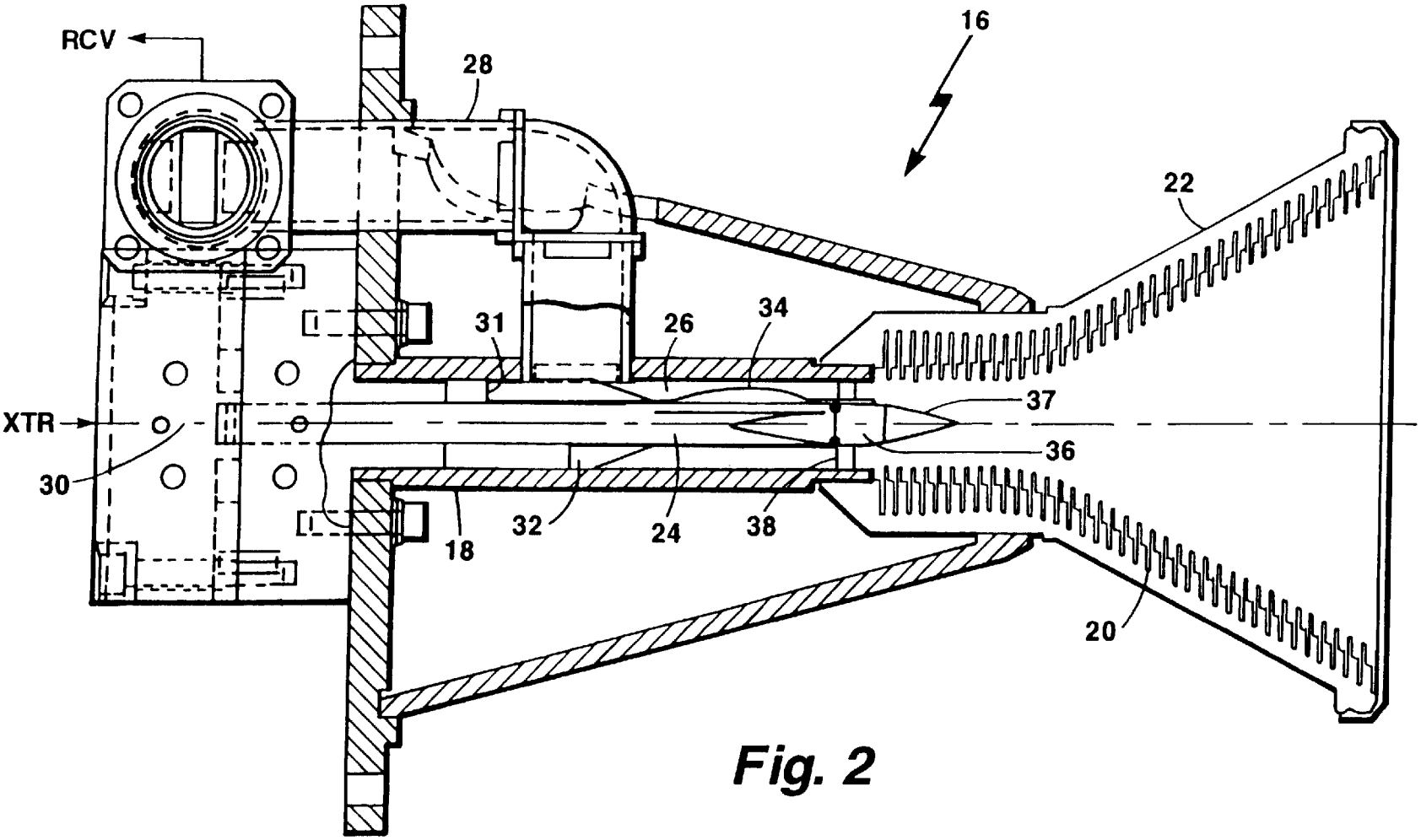
FIG. 2 is a cross-sectional view of a dual band feed assembly shown in FIG. 1 taken along line 2—2.

Referring now to FIG. 2, a cross-section of the dual band feed assembly 16 of FIG. 1 is shown which comprises a feed waveguide 18 coupled to a corrugated horn 22. The corrugated horn 22 comprises an integral mode transducer 21 located adjacent to the junction with the feed waveguide 18. The feed waveguide 18 comprises two concentric, circular waveguides 24, 26; the inner waveguide 24 is for Q-band (43.5–45.5 GHz) and the outer waveguide 26 is for K-band (20.2–21.2 GHz); hence, the two bands are separated by a 2.15 factor. Q-band is used for transmit and K-band is used for receive. A rectangular waveguide 28 is connected to the circular waveguide 26 for feeding the Q-band signal. A Q-band polarizer block 30 is provided and it is attached to the Q-band circular waveguide 24 to generate the required sense of circular polarization. A stepped transition to coaxial waveguide 31 is disposed above the Q-band circular waveguide 24 and before the rectangular waveguide 28 for the transition from rectangular to coaxial waveguide at K-band. A K-band polarizer 34 is positioned in the K-band circular waveguide 26 on top of the Q-band circular waveguide 24 to generate the required sense of circular polarization. A teflon plug 36 having a cone shape 37 on each end is positioned in the end of the Q-band circular waveguide 24 at the junction with the corrugated horn 22. A dielectric ring 38 is positioned in the K-band circular waveguide 26 surrounding the plug 36 in the Q-band circular waveguide 24. A narrow diameter end of the corrugated horn 22 is disposed around the end of the K-band circular waveguide 26 at the location of the dielectric ring 38.

Figure 3:
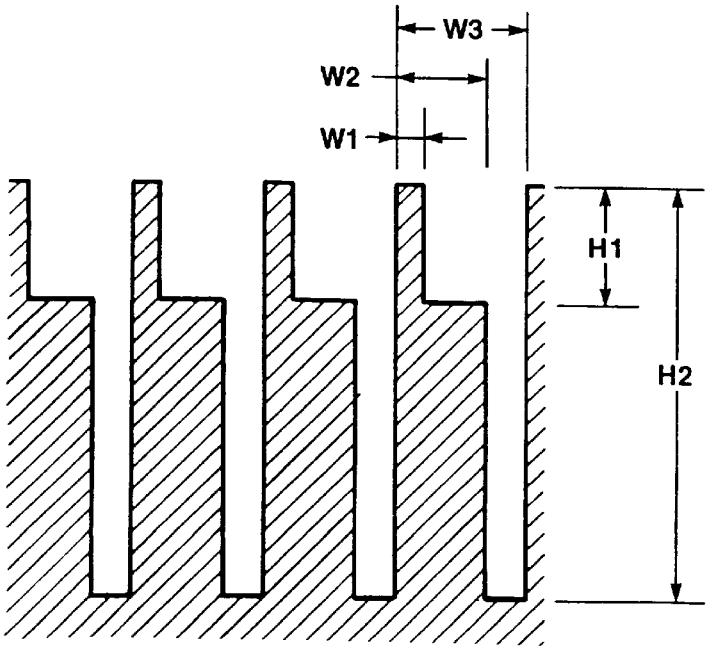
FIG. 3 is an exploded illustration of stepped-slot corrugation on the inner periphery of the horn identifying width and height dimensions.

Referring to FIG. 2 and FIG. 3, the corrugated horn 22 comprises a plurality of stepped-slots 20 on an inner periphery of the horn 22. At the narrow diameter, straight end of the corrugated horn 22 the dimensions of the stepped-slots 20 vary forming the mode transducer 21. As the corrugated horn starts to flare, the dimensions of stepped-slots 20 become constant. The transition from a straight to a flared waveguide is achieved by incrementing the flare angle of the horn 22 until a desired angle is achieved. Each of the first seven corrugations of the horn 22 are depressed 4 degrees relative to the orientation of the prior corrugation. After the seventh corrugation the horn 22 flare angles remain constant at 28 degrees. Hence, the corrugated horn 22 has a 2.2 inch flared aperture and a 28 degree flare angle. FIG. 3 shows an enlarged illustration of the stepped-slot corrugation with W1, W2 and W3 identifying width dimensions and H1 and H2 height dimensions; nominal valves for these dimensions are as follows:

| NOMINAL DIMENSI0NS |
|---|
| H1 = 0.060" |
| H2 = 0.210" |
| W1 = 0.013" |
| W2 = 0.030" |
| W3 = 0.050" |

Referring again to FIG. 2, the K-band outer circular waveguide 26 is excited on transmit in a $TE_{11}$ coaxial waveguide mode and the Q-band circular waveguide 24 is excited on receive in a $TE_{11}$ circular waveguide mode. This is a typical waveguide configuration for dual band applications where concentric or common radiating apertures are utilized. The function of the mode transducer 20, which is critical to the performance of the feed 16, is to provide a single mode, low return loss transition for both bands between the feed waveguide 18 and the stepped-slot corrugated horn 22. This is achieved by converting the $TE_{11}$ circular waveguide mode into a fundamental hybrid $HE_{11}$ mode of the corrugated horn 22. The stepped-slot corrugated horn is designed to achieve a smooth transition from the mode transducer 21 and to produce the desired radiation characteristics at both frequency bands.

The Q-band surface reactance of the mode transducer 21 remains constant and capacitive; at K-band the surface reactance changes from zero to capacitive. This is accomplished by utilizing the stepped-slot corrugations shown in FIG. 3. By adjusting the depth and/or width of the two slots the surface reactance of the waveguide can be independently controlled at both frequency bands. To simplify fabrication, the surface reactance may be controlled by varying only the depth of the two slots.

At the junction of the feed waveguide 18 and the mode transducer 21 the Q-band electric field distribution is similar to that of the $HE_{11}$ mode, i.e. maximum field intensity at the center and null field at the outer diameter. As a result of the field distribution and the capacitive Q-band surface reactance of the transducer 20, the conversion of the $TE_{11}$ to the $HE_{11}$ mode occurs at the waveguide junction. The diameter of the mode transducer 21 was selected so that any higher order hybrid modes excited at the waveguide junction would be below cut-off. Since the Q-band surface reactance remains capacitive, the $HE_{11}$ mode propagates through the mode transducer 21 undisturbed.

At K-band the electric field intensity at the junction of the feed waveguide 18 and the mode transducer 21 is opposite that of the $HE_{11}$ mode. Because of this the transducer needs to perform two modal conversions. First, the $TE_{11}$ coaxial waveguide mode is converted to a $TE_{11}$ circular waveguide mode. The zero K-band surface reactance at the junction of the feed waveguide 18 and the transducer 21 causes the conversion to the $TE_{11}$ circular waveguide mode. The diameter of the mode transducer 21 was selected so that any higher order waveguide modes excited at the junction would be below cut-off. As the mode propagates away from the feed waveguide junction, the surface reactance of the transducer varies from zero to capacitive converting the $TE_{11}$ mode to the $HE_{11}$ mode, and thereby accomplishing the second conversion.

Since the desired modes have been excited, the function of the final section of the feed, the corrugated horn 22, is to propagate the fundamental hybrid modes and provide a smooth transition from straight to flared corrugated waveguide. The first requirement is achieved by repeating the last stepped-slot corrugation 20 of the mode transducer 21 along the length of the horn. Although the electrical characteristics of the corrugations change with the diameter of the horn, the surface reactance of the horn remains capacitive. This ensures the propagation of the fundamental hybrid modes and eliminates the need for varying the dimensions of the corrugations along the length of the horn.

This concludes the description of the preferred embodiment. However, many modifications and alterations will be obvious to one of ordinary skill in the art without departing from the spirit and scope of the inventive concept. Therefore, it is intended that the scope of this invention be limited only by the appended claims.

What is claimed is:

1. A dual band feed comprising:

a waveguide feed structure adapted to support low band signals and high band signals;

a corrugated horn having a relatively narrow throat region disposed adjacent to said waveguide feed structure, said corrugated horn being adapted to support propagation of both of said low band signals and said high band signals at said throat region; said corrugated horn comprising a mode transducer including varying stepped-slots having varying depths on a portion of an inner periphery of said corrugated horn, the varying stepped slots sized and configured to support propagation of both of said low band and said high band signals for providing a single mode, low return loss transition of said low band and said high band signals, for converting a $TE_{11}$ circular waveguide mode of said high band signals to an $HE_{11}$ mode at a junction of said corrugated horn with said waveguide feed structure for converting a $TE_{11}$ coaxial waveguide mode of said low band signals to the $TE_{11}$ circular waveguide mode at the junction; and for converting said $TE_{11}$ circular waveguide mode to the $HE_{11}$ mode as said $TE_{11}$ circular waveguide mode propagates away from said junction and said throat region of said corrugated horn.

2. The dual band feed as recited in claim 1 wherein:

said waveguide feed structure comprises two concentric circular waveguides.

3. The dual band feed as recited in claim 2 wherein:

a first of said circular waveguides for said low band signals is excited in a $TE_{11}$ coaxial waveguide mode; and a second of said circular waveguides for said high band signals is excited in a $TE_{11}$ circular waveguide mode.

4. The dual band feed as recited in claim 1 wherein said waveguide feed structure comprises a high band waveguide having a plug with a conical shape on each end, said plug positioned near an end of said waveguide feed structure to provide a smooth transition from said waveguide feed structure to said mode transducer and for improving isolation between a high band port and a low band port of said said dual band feed.

5. The dual band feed as recited in claim 4 further comprising a low band coaxial waveguide surrounding said high band waveguide and including a dielectric ring disposed therein for optimizing return loss.

6. The dual band feed as recited in claim 1 wherein said low band comprises K-band signals and said high band comprises Q-band signals.

7. A dual frequency reflector antenna comprising:

a main reflector;

a subreflector assembly positioned in front of said main reflector for illuminating said main reflector;

a dual band feed assembly adapted to transmit high band signals and receive low band signals, said feed assembly comprising:

a waveguide feed structure adapted to support said low band signals and said high band signals; and a corrugated horn having a relatively narrow throat region disposed adjacent to said waveguide feed structure, said corrugated horn being adapted to support propagation of both of said low band signals and said high band signals;

said corrugated horn including a mode transducer having a plurality of stepped slots on a portion of an inner periphery of said corrugated horn and having varying dimensions preselected to support propagation of both of said low band and said high band signals, for converting a $TE_{11}$ circular waveguide mode of said high band signals to an $HE_{11}$ mode at a junction of said corrugated horn with said waveguide feed structure and for converting a $TE_{11}$ coaxial waveguide mode of said low band signals to the $TE_{11}$ circular waveguide mode at the junction; and for converting said $TE_{11}$ coaxial waveguide mode to the $HE_{11}$ mode as said $TE_{11}$ waveguide mode propagates away from said junction and said throat region of said corrugated horn.

8. The dual band reflector antenna as recited in claim 7 wherein:

said waveguide feed structure comprises two concentric circular waveguides.

9. The dual band antenna reflector as recited in claim 8 wherein:

a first of said circular waveguides for said low band signals is excited in a $TE_{11}$ coaxial waveguide mode; and a second of said circular waveguides for said high band signals is excited in a $TE_{11}$ circular waveguide mode.

10. The dual band reflector antenna as recited in claim 7 wherein said waveguide feed structure comprises a high band waveguide having a plug with a conical shape on each end, said plug positioned near an end of said waveguide feed structure and configured to provide a smooth transition from said waveguide means to said mode transducer means and for improving isolation between a high band port and a low band port of said antenna.

11. The dual band reflector antenna as recited in claim 10 wherein said dual band feed assembly comprises a low band coaxial waveguide surrounding said high band waveguide and including a dielectric ring disposed therein for optimizing return loss.

12. The dual band reflector antenna as recited in claim 7 wherein said low band comprises K-band signals and said high band comprises Q-band signals.

13. A dual band antenna assembly comprising:

a corrugated horn having:

a relatively narrow throat region at a proximal end of the corrugated horn and a relatively wide region at a distal end of the corrugated horn, said corrugated horn being adapted to support propagation of both low band signals and high band signals at said throat region; and varying stepped-slots having varying depths on a portion of an inner periphery of said corrugated horn for providing a single mode, low return loss transition of said low band and said high band signals; and a waveguide feed structure, terminating at the relatively narrow throat region and adapted to support said low band signals and high band signals.

14. The dual band antenna assembly as recited in claim 13 wherein said waveguide feed structure includes two concentric circular waveguides, a first of said circular waveguides for said low band signals is excited in a $TE_{11}$ coaxial waveguide mode; and a second of said circular waveguides for said high band signals is excited in a $TE_{11}$ circular waveguide mode.

15. The dual band antenna assembly as recited in claim 14 further comprising a dielectric ring in the first of said circular waveguides to optimize return loss.

16. The dual band antenna assembly as recited in claim 13 wherein said dual band antenna assembly converts a $TE_{11}$ circular waveguide mode of said high band signals to a $HE_{11}$ mode at a junction of said corrugated horn and waveguide feed structure.

17. The dual band antenna assembly as recited in claim 13 wherein said dual band antenna assembly converts a $TE_{11}$ coaxial waveguide mode of said low band signals to a $TE_{11}$ circular waveguide mode at a junction of said corrugated horn and waveguide feed structure and converts said $TE_{11}$ circular waveguide mode to an $HE_{11}$ mode as said $TE_{11}$ circular waveguide mode propagates away from the junction.

18. The dual band antenna assembly as recited in claim 13 wherein said waveguide feed structure includes a high band waveguide having a plug with a conical shape on each end, said plug positioned near an end of said waveguide feed structure to provide a smooth transition from said waveguide feed structure to said corrugated horn means and to improve isolation between a high band port and a low band port of said antenna assembly.

19. The dual band antenna assembly as recited in claim 13 wherein said low band comprises K-band signals and said high band comprises Q-band signals.

* * * * *